United States Patent [19]

Kondo et al.

[11] Patent Number: 4,903,301

[45] Date of Patent: Feb. 20, 1990

[54] METHOD AND SYSTEM FOR TRANSMITTING VARIABLE RATE SPEECH SIGNAL

[75] Inventors: Kazuhiro Kondo, Kokubunji; Toshiro Suzuki, Tama, both of Japan

[73] Assignee: Hitachi, Ltd., Chiyoda, Japan

[21] Appl. No.: 155,392

[22] Filed: Feb. 12, 1988

[30] Foreign Application Priority Data

Feb. 27, 1987 [JP] Japan ..... 62-42554

[51] Int. Cl.[4] ..... G10L 5/00

[52] U.S. Cl. ..... 381/30; 381/31; 375/122

[58] Field of Search ..... 381/30, 31; 370/81; 375/122

[56] References Cited

U.S. PATENT DOCUMENTS 4,095,052 6/1978 Ching et al. ..... 370/81
4,617,676 10/1986 Jayant ..... 381/30
4,726,037 2/1988 Jayant ..... 381/30

FOREIGN PATENT DOCUMENTS 60-150100 3/1985 Japan .

OTHER PUBLICATIONS

IEEE ASSP Magazine, vol. 1, No. 2, (1984), pp. 4–29, "Vector Quantization".
"The Residual Excited Linear Prediction Vocoder with Transmission Rate Below 9.6 KBPS", by C. K. Un and D. T. Megill, IEEE Trans. 1975.
"A New Model of LPC Excitation for Producing Natural Sounding Speech at Low Bit Rates", by B. S. Atal et al., Processing ICASSP 82 (1982).
"Bit Allocation in Time and Frequency Domains for Predictive Coding of Speech", by M. Honda et al., IEEE Trans. Acoustics Speech . . . 1984.
The Bell System Technical Journal, vol. 58, No. 3, Mar. 1979, pp. 577–600.
Technical Research Report of the Institute of Electronics Communication Engineers of Japan, SP86–48, (1986), pp. 31–38.
Foundation of Speech Information Processing, by Kazuo Nakata, Ohm Publishing Co., (1981).

*Primary Examiner*—E. S. Kemeny
*Attorney, Agent, or Firm*—Pennie & Edmonds

[57] ABSTRACT

A speech signal transmission system for transmitting coded speech signals with variable bit rate is disclosed, which comprises a coder for analyzing digital speech signals inputted in a one-frame period and transforming them into coded data comprising a plurality of parameters indicating characteristics of the inputted speech signals, a data arranging circuit for arranging the coded data outputted by the coder in the order of the priority in the decoding of the speech signals and outputting them, and a bit stealer allowing a series of coded data outputted successively by the data arranging circuit to pass through only in a period of time determined by the transmission bit rate. The bit arranging circuit outputs the parameters in the order of the priority of decomposes each of them in unit of a bit and outputs them with decreasing priority. Parameters or bits of low priority are omitted by the bit stealer, depending on the transmission bit rate. One the receiver side the parameters are extracted and the speech signals are decoded on the basis of arrangement type identification codes transmitted together with the coded data.

11 Claims, 11 Drawing Sheets

METHOD AND SYSTEM FOR TRANSMITTING VARIABLE RATE SPEECH SIGNAL

BACKGROUND OF THE INVENTION

1. Field of the Invention

This invention relates to a speech processing system, and more particularly to a variable rate speech signal transmission method, by which the bandwidth of the speech signal is made variable, depending on the required transmission bit rate, and a system for realizing the method.

2. Description of the Related Art

In the case where speech signals are transmitted through a digital communication system, variable rate speech signal transmission techniques controlling the bandwidth of the signals, depending on the state of the transmission path, are desired.

Heretofore the variable rate coding of speech by the waveform coding method, by which the generation mechanism of speech is not taken into account, is discussed e.g. in the Bell System Technical Journal, Vol. 58, No. 3, March 1979, pp. 577–600. Further, the variable rate coding of speech by the source coding method, by which speed compression is effected by modeling the generation mechanism of the speech is described e.g. in Technical Research Report of the Institute of Electronics Communication Engineers of Japan, SP 86-48 (1986) pp.31–38.

However, by the former, the variable rate coding of speech by the waveform coding method, since the number of bits used for the quantization of each sample of the input waveform is changed, depending on the transmission rate, it is not possible to exclude the redundancy due to the speech generation mechanism, which is characteristic of the speech, and in a transmission system having a bit rate lower than 32k bits per second (bps) it is difficult to obtain practical compressed signals. On the other hand, by the latter, the variable rate coding of speech by the source coding method, although it is possible to obtain compressed speech signals bit for practical use for the bit rates lower than 32k bps, according to the coding method disclosed in the literature state above, e.g. for the bit rates higher than 8k bps the APC-MLQ (Adaptive Predictive Coding with Maximum Likelihood Quantization) is adopted and it is switched over for the bit rates lower than 7.2k bps to the hybrid coding combining the base band coding based on APC-MLQ algorithm and the high frequency regeneration method. According to this method, since the algorithm for the compressing processing is switched over depending on the bit rate, it has a problem that the construction of the coder and the decoder is too complicated.

SUMMARY OF THE INVENTION

An object of this invention is to provide a speech signal transmission method and a system for realizing the capability of transmitting coded speech signals with variable transmission bit rate without changing the algorithm for speech compressing processing.

Another object of this invention is to provide a speech signal transmission method with variable rate and a system for realizing same, which are suitable for transmitting speech signals data-compressed especially by the source coding method.

In order to achieve the first object stated above, the method for transmitting coded speech signals with variable bit rate according to this invention is characterized in that it comprises:

a first step for analyzing speech signals inputted during a predetermined period and transforming them into a plurality of coded data indicating features of the inputted speech;

a second step for rearranging the plurality of coded data according to the order of the priority in the decoding of the speech; and a third step for transmitting the rearranged coded data stated above according to the order of the priority by the amount determined by the transmission bit rate.

The rearrangement of the coded data includes the case where each of the coded data is decomposed e.g. in unit of a bit and rearranged according to the order of bits of decreasing priority. In this case the rearrangement of the bits of the coded data can be effected by preparing previously a plurality of sort patterns and being based on one of the sort patterns selected depending on the inputted speech signal. The rearrangement of the data bits may be tried with a plurality of sort patterns and effected by estimating the deterioration of the coded speech in the case where a bit steel is effected, depending on the transmission rate, for each of the data series thus obtained, and adopting a data series having the bit arrangement, for which the deterioration is the smallest.

The arrangement of coded data stated above may be effected by outputting the data according to the order of decreasing priority in unit of characteristic data or parameter so that data or parameter having small influences on the speech quality is subjected to bit steal.

For example, in the case where the inputted speech cannot be reproduced (synthesized) accurately from the coded data of the first group obtained by coding the inputted speech with a certain coding algorithm but contains errors, the quality of the decoded speech can be further improved, if the errors stated above are previously estimated at the coding of the inputted speech, transformed further into the coded data of the second group and sent together with the coded data of the first group. In this case, since the priority of the decoding process of the speech is given to the coded data of the first group, if the data are so arranged that they are outputted at first and then the coded data of the second group are outputted thereafter, when the transmission bit rate is restricted, the bit steal can be effected with increasing priority of the coded data of the second group.

A speech signal transmission system for transmitting coded speech signals with variable bit rate according to this invention comprises:

coding means for analyzing speech signals inputted during a predetermined period and transforming them into a plurality of coded data indicating characteristics of the inputted speech;

data arranging means coupled with the coding means for outputting the coded data with decreasing priority at the coding of speech; and means allowing a series of the coded data outputted by the data arranging means to pass by a data amount determined by the specified transmission bit rate from the top.

The coding means described above stores digital speech signals inputted from an A/D converter with a predetermined sampling period and analyzes characteristics of the inputted speeches, using a plurality of sampled signals inputted during a 1-frame period.

For the coding means it is desirable to utilize a coder according to the source coding method. According to the source coding method, characteristic parameters such as the frequency spectrum of the speech signals, the pitch period of the speech signals, sound source information for each pitch period, etc. are extracted for every frame. The typical source coding system is known as PARCOR (Partial Autocorrelation). According to the PARCOR method it is judged for each frame whether it is voiced or unvoiced, and as the sound source signal at the synthesis of the speech white noise is used for an unvoiced frame and a single pulse for every pitch period for a voiced frame. Since the source signal is simplified, the deterioration of the speech quality is large, although the amount of speech data can be compressed to a great extent. The speech quality can be improved by adopting a coder using a plurality of excitation pulses per pitch period. When the number of pulses indicating the sound source increases, the number of characteristic parameters and the amount of the data become large. However, according to this invention, it is possible to improve the quality of reproduced speech, depending on the bit rate by arranging the coded data according to the priority of these characteristic parameters. It may be also possible to give parameters having a high priority a bit length sufficiently long and to reduce the numerical precision for parameters having a low priority by applying bit stealing,-while decomposing each of the bit data in unit of a bit and rearranging them.

The foregoing and other objects, advantages, manner of operation and novel features of the present invention will be understood from the following detailed description when read in connection with the accompanying drawings.

DESCRIPTION OF THE PREFERRED EMBODIMENTS

Figure 1:
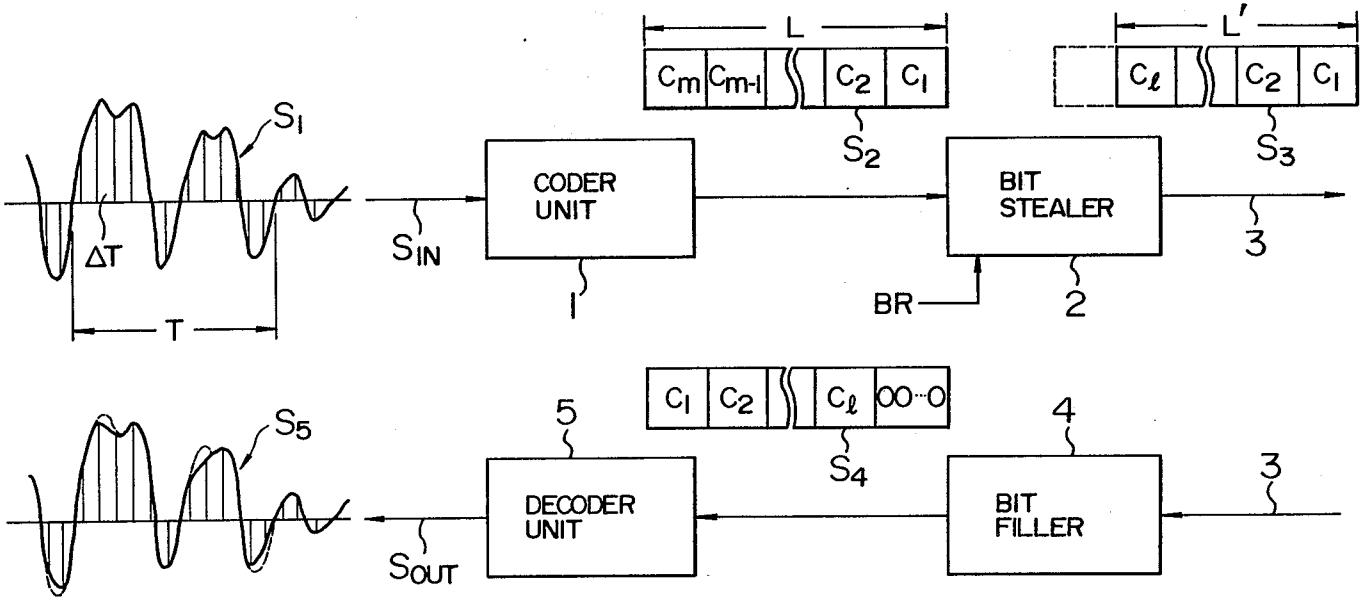
FIG. 1 is a scheme for explaining the whole construction of a variable rate speech coding/decoding system according to this invention and the summary of the operation thereof.

FIG. 1 is a block diagram illustrating the whole construction of a speech coding/decoding system according to this invention.

A speech signal $S_1$ is sampled with a predetermined time period $\Delta T$ (e.g. 125 $\mu$sec) and inputted in a coding unit 1 in the form of a digital signal $S_{IN}$. The coding unit 1 includes a bandwidth compression coder according to the source coding method explained later, extracts characteristics of the inputted speech from the inputted signal corresponding to N (=160) sampled signals inputted during a predetermined period T (e.g. 20 msec), and transforms them into coded data consisting of a plurality of parameters. According to this invention the coding unit 1 outputs a data series $S_2$, in which the parameters constituting the coded data described above or the bits constituting each of the parameters are arranged with the order of decreasing influence given to the quality of the speech. In the example indicated in the figure, the data series $S_2$ having a length L and consisting of data elements $C_1$–$C_m$ arranged according to its priority are outputted by the coding unit 1 and they are inputted in a bit stealer 2 for controlling the amount of transmitted data. The bit stealer 2 sends data $S_3$ having a length L′ specified by a rate control signal BR from the head of the inputted data series $S_2$ to a transmission line 3 and omits the portion exceeding the length L′.

On the other hand, the coded speech signal $S_3$ received from another apparatus or station through a transmission line 3 is inputted in a bit filler and after having been transformed in a data series $S_4$ obtained by replacing the bits of lower priority of the data series $S_2$ omitted at the transmission by "0", it is inputted in a decoding unit 5. The decoding unit 5 extracts parameters from each of the speech signals from the data series $S_4$ and decodes the sound on the basis of these parameters. The decoded speech signals $S_5$ suffer from deterioration due to the bit steal. However, according to this invention, since the bit steal is effected from the parameter or bit, for which its influence on the speech quality is the smallest, in the order of increasing influence, it is possible to obtain a reproduced speech optimum for the specified bit rate.

Figure 2:
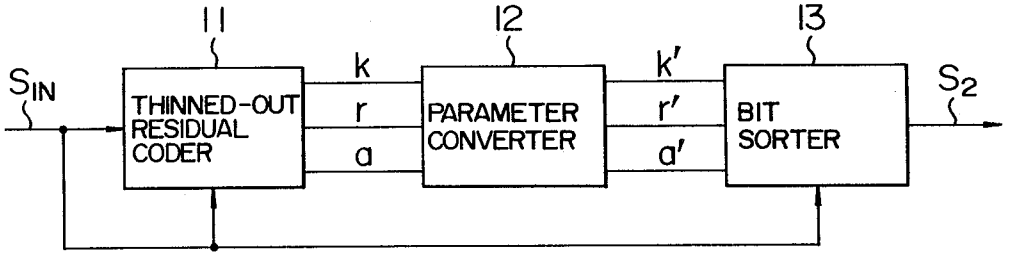
FIG. 2 is a block diagram illustrating an embodiment of a coder unit 1 in FIG. 1.

The coding unit 1 can be constructed e.g. by a coder 11 according to the thinned-out residual method, a parameter converter 12 and a bit sorter 13, as indicated in FIG. 2.

The thinned-out residual method is one of the source coding method, by which the waveform of the speech signal inputted in a period e.g. of 20 msec (frame) is analyzed and separated into frequency spectrum information (spectrum envelope characteristics) and source information consisting of a pulse train (residual signal) obtained by excluding the spectrum envelope characteristics stated above from the inputted speech signal and a plurality of residual pulses are selectively extracted. The coder and the decoder based on this method are described e.g. in Japanese patent application No. Sho 59-5583 (JP-A-60-150100).

Figure 3A:
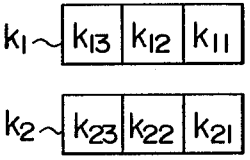
FIGS. 3A to 3C show the construction of three different coded data.
Figure 3B:
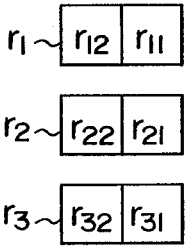
Figure 3C:
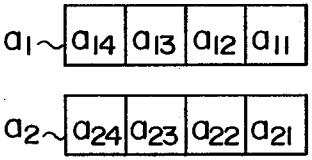

The coder 11 according to the thinned-out residual method indicated in FIG. 2 transforms the inputted speech signal $S_{IN}$ into coded data consisting of three parameters, i.e. a spectrum parameter (k) representing the spectrum envelope characteristics of the speech, an excitation residual signal (r) obtained by compressing the residual signal (residual pulse) and supplementary or side information (a) representing the pitch or power of the speech signal. The spectrum parameter (k) indicates the phoneme contained in that frame and in this example 2 parameters $k_1$ and k2, each of which consists of 3 bits, are selected therefor, as indicated in FIG. 3A. The excitation residual signal (r) is a parameter indicating personal characteristics such as "roughness" and "huskiness" of the voice and 3 parameters, each of which consists of 3 bits, are selected therefor, as indicated in FIG. 3B. Further, for the supplementary information (a), 2 parameters, each of which consists of 4 bits, are selected, as indicated in FIG. 3C. In a practical application the number of the parameters k and r and the number of bits may be greater. Here, for the sake of the convenience of explanation, only small numbers are used therefor.

The compressed data consisting of these parameters are inputted in the parameter converter 12 and transformed in a data format k', r', a', by which influences on the speech quality are small, even if bits of lower order are omitted in the following bit stealer 13.

For example; the spectrum parameter k can be obtained in the form of the partial autocorrelation (PARCOR) coefficient in the thinned-out residual coder 11. However, it is known that the decrease in the speech quality due to the reduction of the bit number can be lowered by representing this PARCOR coefficient by line spectrum pairs (LSP). The PARCOR coefficient and the LSP are described in detail e.g. in "Foundation of Speech Information Processing" by Kazuo NAKATA, Ohm Publishing Co. (1981) (in Japanese).

Furthermore the excitation residual signal r and the supplementary information a are expressed frequently by a "2' complement". However, when bits of lower order of the numerical data expressed in this way by the "2' complement" are omitted, it gives rise to an error in the negative direction. Consequently, when calculation is effected by using parameters data-compressed by omitting bits of lower order, errors in the negative direction are accumulated and enlarge the error (decrease in the speech quality). On the contrary, when each of the parameters r and a described above is rewritten in a signed magnitude code, even if bits of lower order are omitted, errors are produced only in the direction, where the magnitude decreases. For example, for data, whose average value before the quantization is zero, the average value after the omission of the bits of lower rank is also zero and the accumulation of errors, which has been explained for the expression in the "2' complement", is not produced. The parameter converter 12 transforms the output parameters k, r and a of the thinned-out residual coder 11 into parameters k', r' and a' of data expression format, for which influences of the bit steal described previously are small.

The bit sorter 13 decomposes the parameters k', r' and a' in unit of a bit and rearranges the bits thus obtained in the order, by which bits having smaller influences on the speech quality are located at a lower order. In this case the degree of the influences, which each of the parameters gives to the speech quality after the reproduction, is different, depending on the kind of the inputted speech contained in the relevant frame. Consequently it is desirable that a plurality of kinds of sort types are prepared previously in the bit sorter 13 and the bit sorting process is effected, while selecting a sort type for every frame, depending on the kind of the inputted speech.

Figure 4:
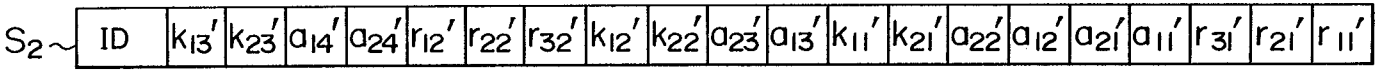
FIG. 4 shows a data series $S_2$ outputted by a bit sorter 13.
Figure 5:
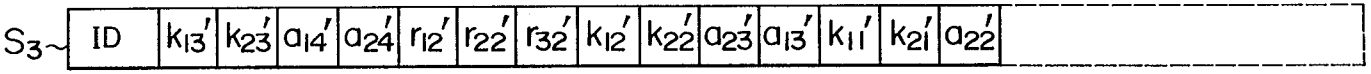
FIG. 5 shows a data series $S_3$ subjected to a bit steal.
Figure 6:
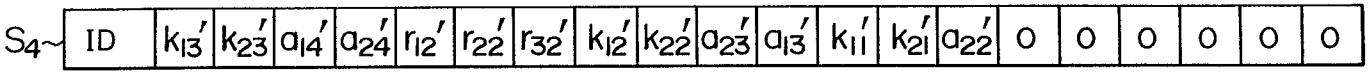
FIG. 6 shows a data series $S_4$ outputted by a bit filler 4.

FIG. 4 shows an example of the data series $S_2$ after the bit sort. The ID located at the head is an indicator for indicating the sort type applied to this data series. Lower bits (6 bits in this example) of this data series $S_2$ are omitted by the bit stealer 2 and the data series $S_3$ thus compressed, as indicated in FIG. 5, are sent to the transmission line. FIG. 6 shows the data series $S_4$, in which the lower bits are replaced by "0" by the bit filler 4 in the receiver side.

Figure 7:
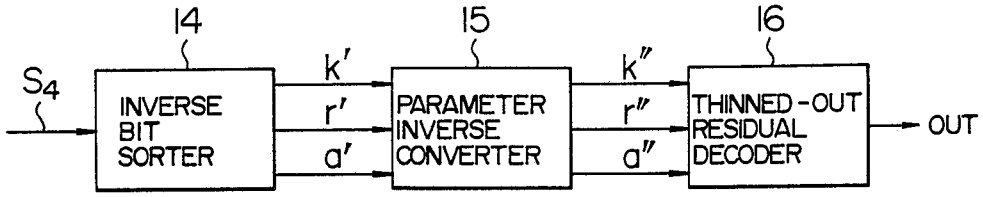
FIG. 7 is a block diagram illustrating an embodiment of a decoder unit 5 in FIG. 1.
Figure 8A:
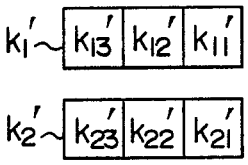
FIGS. 8A to 8C show the construction of three different coded data reproduced by an inverse bit sorter.
Figure 8B:
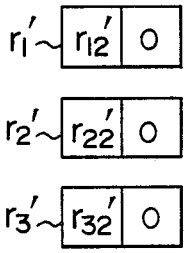
Figure 8C:
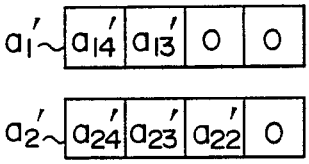

FIG. 7 is a block diagram illustrating the construction of the decoding unit 5 paired with the coding unit 1 having the construction indicated in FIG. 2. This decoding unit 5 rearranges the bits of the data series $S_2$ on the basis of the sort type ID contained in the data series $S_4$. The decoding unit 5 consists of an inverse bit sorter 14 for reproducing each of the parameters $k_1'$-$a_2'$, a parameter inverse converter 15 for reproducing the parameters $k_1'$, $k_2'$ of LSP representation format and the parameters $r_1'$-$a_2'$ of signal magnitude code to parameters $k_1''$, $k_2''$ of PARCOR coefficient and parameters $r_1''$-$a_2''$ of "2' complement" representation format; respectively, and a thinned-out residual decoder 16 reproducing speech signals by using these inversely transformed parameters, as indicated in FIGS. 8A to 8C.

For the thinned-out residual coder 11 and the parameter converter 12 in the coding unit 1, and the parameter converter 15 and the thinned-out residual decoder 16 those known heretofore can be applied. Now the construction of the bit sorter 13 and the inverse bit sorter 14, which are principal parts of this invention, will be explained below.

Figure 9:
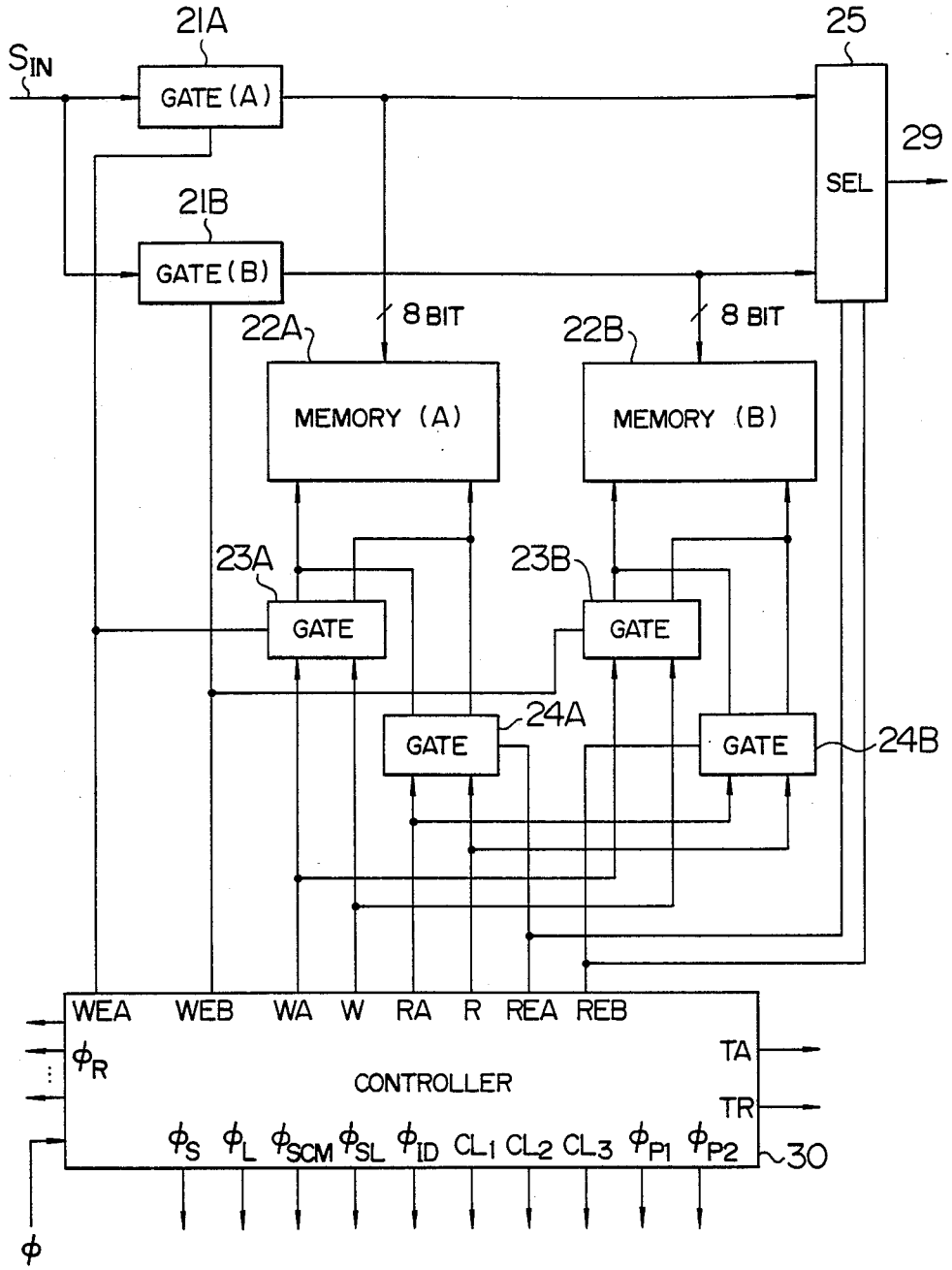
FIGS. 9 and 10 are block diagrams illustrating an example of the concrete construction of the bit sorter 13 indicated in FIG. 2.
Figure 10:
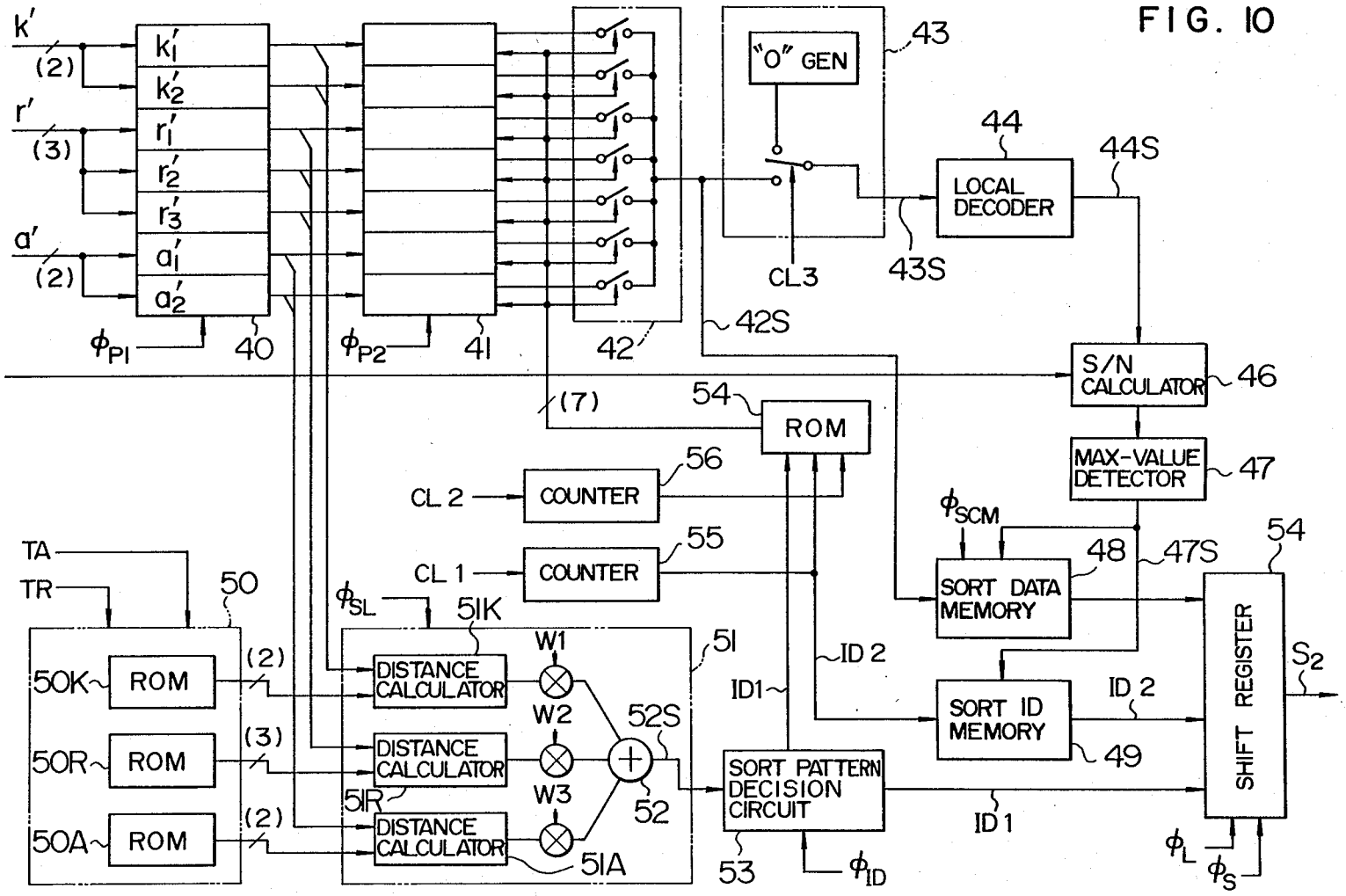

FIGS. 9 and 10 are block diagrams illustrating an example of the construction of the bit sorter 13.

Apart from the parameters k', r' and a' coming from the parameter converter 12, speech signals $S_{IN}$ sampled for every 125 μsec are inputted in the bit sorter 13. The speech signals $S_{IN}$ stated above are inputted in a memory 22A or 22B through a gate 21A or 21B, as indicated in FIG. 9. The gates 21A and 21B are opened alternately for every one-frame period T (e.g. 20 msec) by control signals WEA and WEB outputted by a control circuit 30. A write-in address WA and a write enable signal are given to the memories 22A and 22B through gates 23A and 23B opened in synchronism with the gates 21A and 21B, respectively, by the control circuit 30. Further a read-out address RA and an output enable signal R are given through gates 24A and 24B to these memories. The write-in address WA is up-dated in synchronism with the sampling clock SCL for the speech signal $S_{IN}$. As the result, 160 speech signals sampled in a one-frame period are written successively in one of the memories and speech signals sampled in the succeeding one-frame period are written successively in the other memory. The gates 24A and 24B are opened by control signals, which are in opposite phase with respect to the control signals WEA and WEB, respectively. Consequently, while signals are written in one of the memories, e.g. 22A, speech signals of the preceding one-frame period are read-out from the other memory 22B. The read-out speech signals are outputted through a selector 25 to a signal line 29. By up-dating the read-out address WA with a frequency n times as high as the sampling clock SCL, it is possible to read-out the speech signals n times repeatedly from the other memory 22B to the signal line 29, while speech signals of a one-frame period are inputted in the memory 22A. The control circuit 30 generates various sorts of control signals, which are necessary for the operation of the circuit indicated in FIG. 10, besides the control signals described above.

The parameters k', r' and a' outputted by the parameter converter 12 are taken in a latch circuit 40 disposed for each of the parameters, as indicated in FIG. 10. In this embodiment, in order to find the optimum bit sort type, by which the speech quality is only slightly degraded, at first the inputted speech is roughly categorized and the parameters described above are sorted out in a sort format selected according to the result of the category judgement. Reference numeral 50 represents an ROM for storing template data of a plurality of representative category of speeches used for the judgement of the category of speeches. This ROM consists of an ROM 50K for storing spectrum parameter templates, an ROM 50R for storing excitation residual templates and an ROM 50A for storing supplementary information templates. Read-out of data from each of the ROMs is carried out by a read signal TR and an address signal TA coming from the control circuit 30. For example, in the case where templates are prepared for 4 kinds of speeches, the values of the parameters are read-out for the first template in the order of $[k_1, r_1, a_1]$, $[k_2, r_2, a_2]$, $[r_3]$and these parameters are compared with inputted speech parameters of the latch circuit 40 in a speech category decision circuit 51. When the comparison of all the parameters of the first template with the inputted speech parameters, the parameters of the succeeding template are read-out. The kind of speeches closed to the inputted speech can be found by repeating the operation described above.

Figure 11:
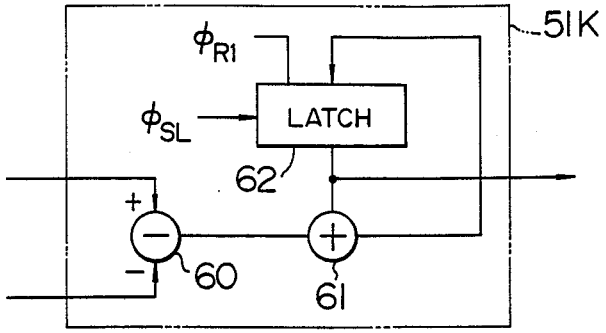
FIG. 11 indicates the construction of a distance calculator 51K indicated in FIG. 10.

The speech category decision circuit 51 is provided with 3 distance calculator circuits 51K, 51R and 51A, each of which is disposed for each of the parameters. The distance calculator circuit 51K consists of a circuit 60 for obtaining the difference between the value of the parameters inputted from the latch circuit 40 and the value of the parameters of the template read-out from the ROM 50K, an adder circuit 61 for accumulating the difference stated above obtained for two parameters $k_1'$ and $k_2'$ and a latch circuit 62, as indicated e.g. in FIG. 11. The other distance calculator circuits have constructions similar to that of the circuit 51K and carry out difference accumulations, depending on the number of the parameters. The latch circuit 62 operates so as to be reset by a reset signal $\phi_{R1}$, every time the templates are switched over, and to take-in the result of the accumulation with a clock $\phi_{SL}$ for every difference accumulation operation.

In the speech category decision circuit 51, the output values of each of the distance calculation circuits 51K-51A are weighted for every parameter and the sum thereof is obtained by the adder 52. The output value of the adder 52 is inputted in a sort pattern decision circuit 53 as decision data 52S for the category of speeches.

Figure 12:
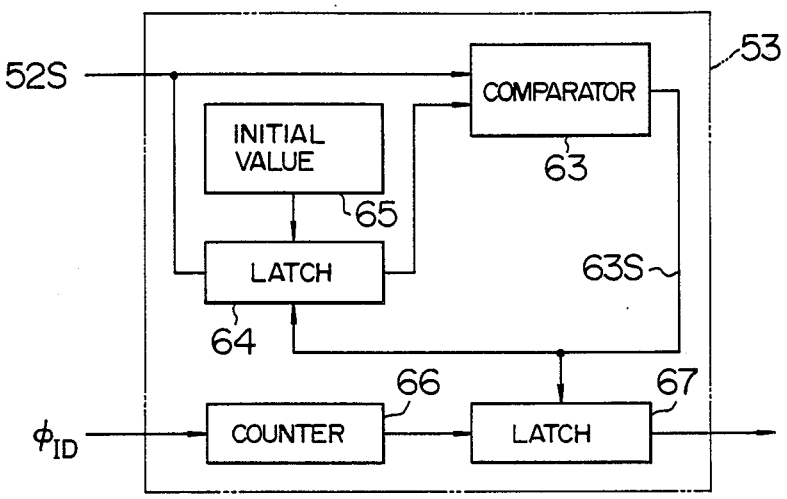
FIG. 12 indicates the construction of a sort pattern decision circuit 53 indicated in FIG. 10.
Figure 13:
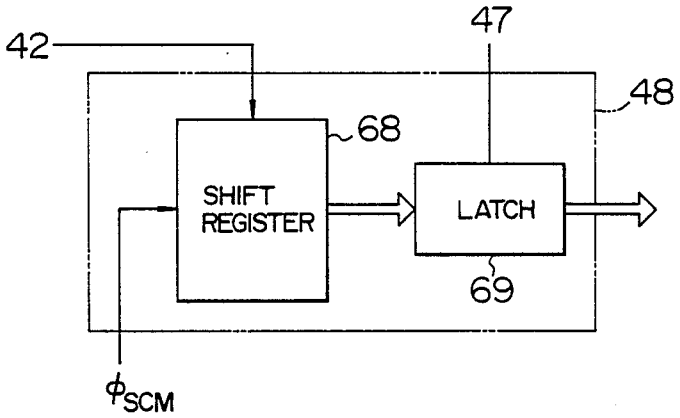
FIG. 13 indicates the construction of a sort data memory 48 indicated in FIG. 10.

The decision circuit 53 includes, as indicated e.g. in FIG. 12, a latch circuit 64 and a comparator 63, which compares decision data 52S with the content of the latch circuit 64. The initial value having the maximum value is set by an initial value generation circuit 65 at the frame switch-over in the latch circuit 64. When decision data having a value smaller than that of this latch circuit 64 is inputted, the decision data 52S are taken in the latch circuit 64 by a latch instruction signal 63S outputted by the comparator 63. The decision circuit 53 is provided further with a counter 66 for counting clock signals $\phi_{ID}$ inputted for every switch over of the template and a second latch 67 taking-in the value of the counter 66, responding to the latch instruction signal 63S. By means of such a construction the identification number ID1 of the template closest to the inputted speech among a plurality of the templates prepared in the ROM 50 is stored in the second latch circuit 67.

An ROM 54 stores a plurality of sort patterns indicating the order of the bit arrangement of the speech data while making them correspond to template identification numbers. In this embodiment a plurality of kinds of sort patterns are prepared in the ROM 54 for every template number and each of the sort patterns consists of 20 7-bit patterns. Each of the bit patterns are composed of 1 "1" bit and 6 "0" bits. Read-out of the bit patterns from the ROM 54 is carried out by using the template identification number ID1 outputted by the decision circuit 53 for the address of higher order, the output of the counter 55 for the address of middle order and the output of the counter 56 for the address of lower order. The counter 55 counts the clock CL1 generated for every termination of the read-out of the speech data corresponding to one frame from one of the memories 22A and 22B and addresses successively the sort patterns prepared, corresponding to the identification numbers ID1 described above. On the other hand the counter 56 counts the clock CL2 and addresses successively 20 7-bit patterns constituting each of the sort patterns.

The bit pattern read out from the ROM 54 stated above is supplied as shift clocks to 7 parallel/serial converters 41 disposed corresponding to each bit and at the same time as control signals to 7 switches constituting the bit sorter 42. A PS converter 41 takes in each of the parameters of the latch circuit 40, responding to a clock signal $\phi_{P2}$, shifts one of the parameters specified by the bit "1" in the bit patterns by one bit and outputs it to the bit sorter 42. At this time, since the switch corresponding to the PS converter, to which the shift clock is given, in the bit sorter 42 is turned-on, the bit outputted by the PS converter is inputted in a local bit stealer 43 and a sort data memory 48 as the output 42S of the bit sorter 42. The bit patterns are read out successively from the ROM 54 in synchronism with the clock CL2. In this way the parameters in the PS converter 41 are outputted bit by bit and supplied to the local bit stealer 43. In a period of time, when the clock CL3 is in the ON state, the local bit stealer 43 transmits the output 42S of the bit sorter to a local decoder 44 in the succeeding stage and when the clock CL3 is turned-off, it blocks the passage of the output of the bit sorter and outputs the "0" bits. Since the ON period of the clock CL3 is proportional to the bit rate, the output 43S of the local bit stealer has a shape, as indicated by the data series $S_4$ in FIG. 1.

In this embodiment it is intended to apply a plurality of sort patterns previously prepared within the ROM 54, corresponding to the template identification numbers ID1, to try various bit sorts for the parameters held in the latch circuit 40 and to output compressed data having the bit arrangement, for which the deterioration of the speech quality after the bit steal is the smallest. The local decoder 44 receiving the output of the local bit stealer 43 acts similarly to the decoding unit 5 in FIG. 5 and outputs a local decoding speech signal 44S for every sort pattern. The local decoding speech signal 44S is inputted in an S/N calculation circuit 46 together with the original speech signal of the relevant frame read-out from the memories 22A and 22B and the obtained S/N value is inputted in a maximum value detection circuit 47. The maximum value detection circuit 47 compares the inputted S/N value with the S/N value (initial value =zero), which has been already stored therein. When the former is greater than the latter, it stores the inputted value and gives at the same time the sort data memory 48 and the sort ID memory 49 the latch signal 47S. The sort data memory 48 consists e.g. of a shift register receiving serial data outputted by the bit sorter 42 in synchronism with the clock $\phi_{SCM}$ and a latch circuit taking-in the content of the shift register stated above and stores compressed speech data having the bit arrangement giving the best S/N among a plurality of sort results. On the other hand the output of a counter 55 is inputted in the sort ID memory 49, which stores the address of lower order ID2 of the sort pattern identification number giving the best S/N.

Figure 14:
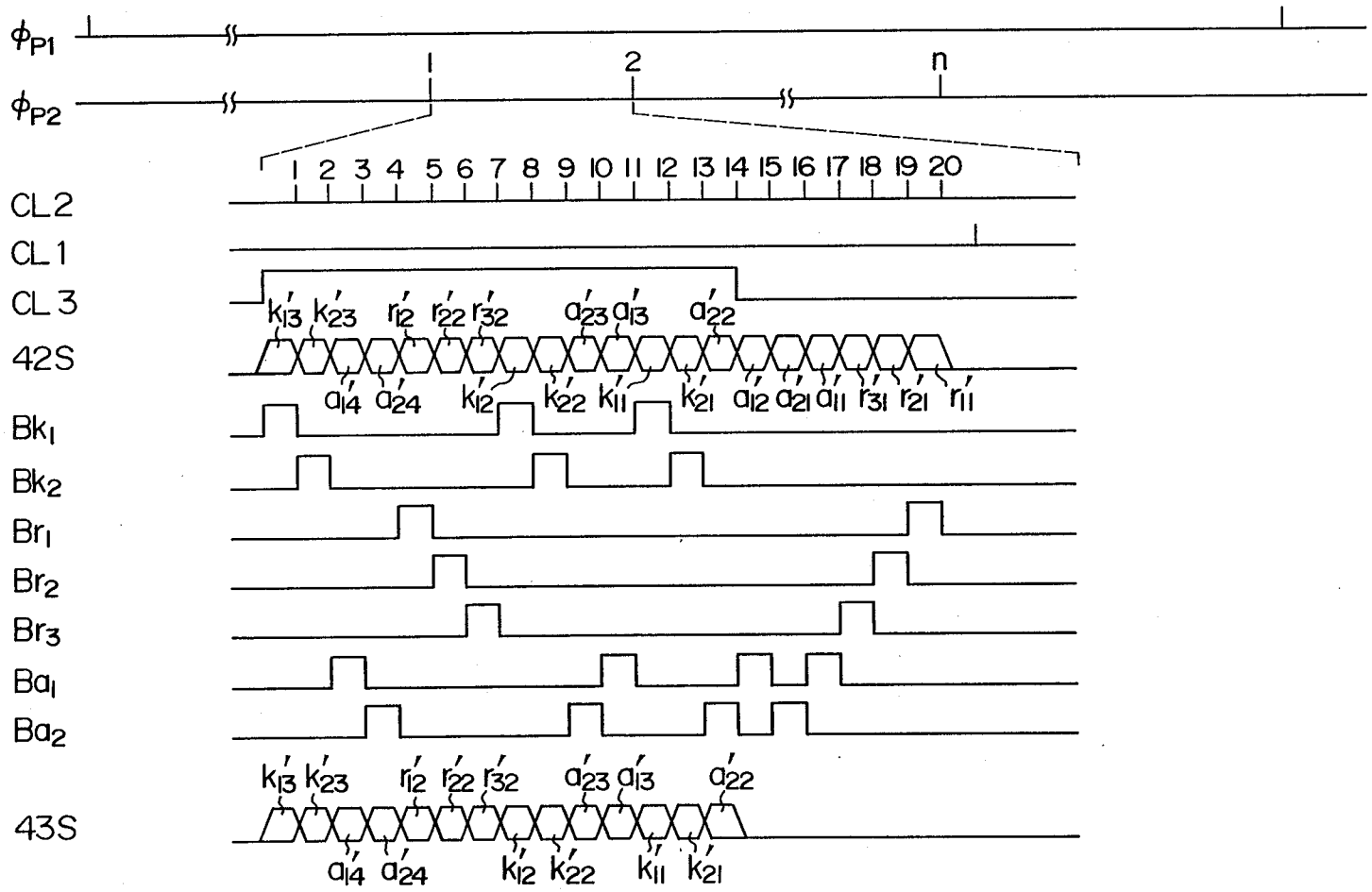
FIG. 14 is a signal timing chart for explaining the operation of the circuit indicated in FIG. 10.

FIG. 14 is a time chart of principal signals relating to the bit sorter operation described above.

$\phi_{P1}$ is a latch instruction pulse given to the latch circuit 40, which is given with a time interval corresponding to the frame period T. $\phi_{P2}$ is a latch instruction pulse given to the PS converter 41 and n of the pulses are outputted, n being equal to the number of times of reading-out sort patterns for every frame. The identification decision of the inputted speech by means of the templates is carried out during a period of time from the moment where $\phi_{P1}$ is outputted to the moment where the first $\phi_{P2}$ is outputted. The clocks CL1–CL3 are given in an interval of outputs of $\phi_{P2}$, as indicated in the figure. $B_{k1}$-$B_{a2}$ indicate bit patterns read out from the ROM 54.

Since, for each frame, n kinds of sort patterns having bit patterns different from each other are read out from the ROM 54, it is possible to maintain the sort result having the bit arrangement, for which the deterioration of the speech quality is the smallest among the n kinds of sort data 42S, even if they undergo the compression (bit steal), depending on the bit rate. The sort data held by the sort data memory 48, the ID2 held by the sort ID memory 49 and the ID1 held by the decision circuit 53 are inputted in parallel in the shift register 54, responding to the clock $\phi_L$ outputted at the point of time, when the local bit sort processing by using n kinds of sort patterns described above, and outputted successively according to the clock $\phi_S$ so as to form the data series $S_2$. In this case, the sort type indicator ID is a combination of ID1 for the bits of higher order and ID2 for the bits of lower order.

Figure 15:
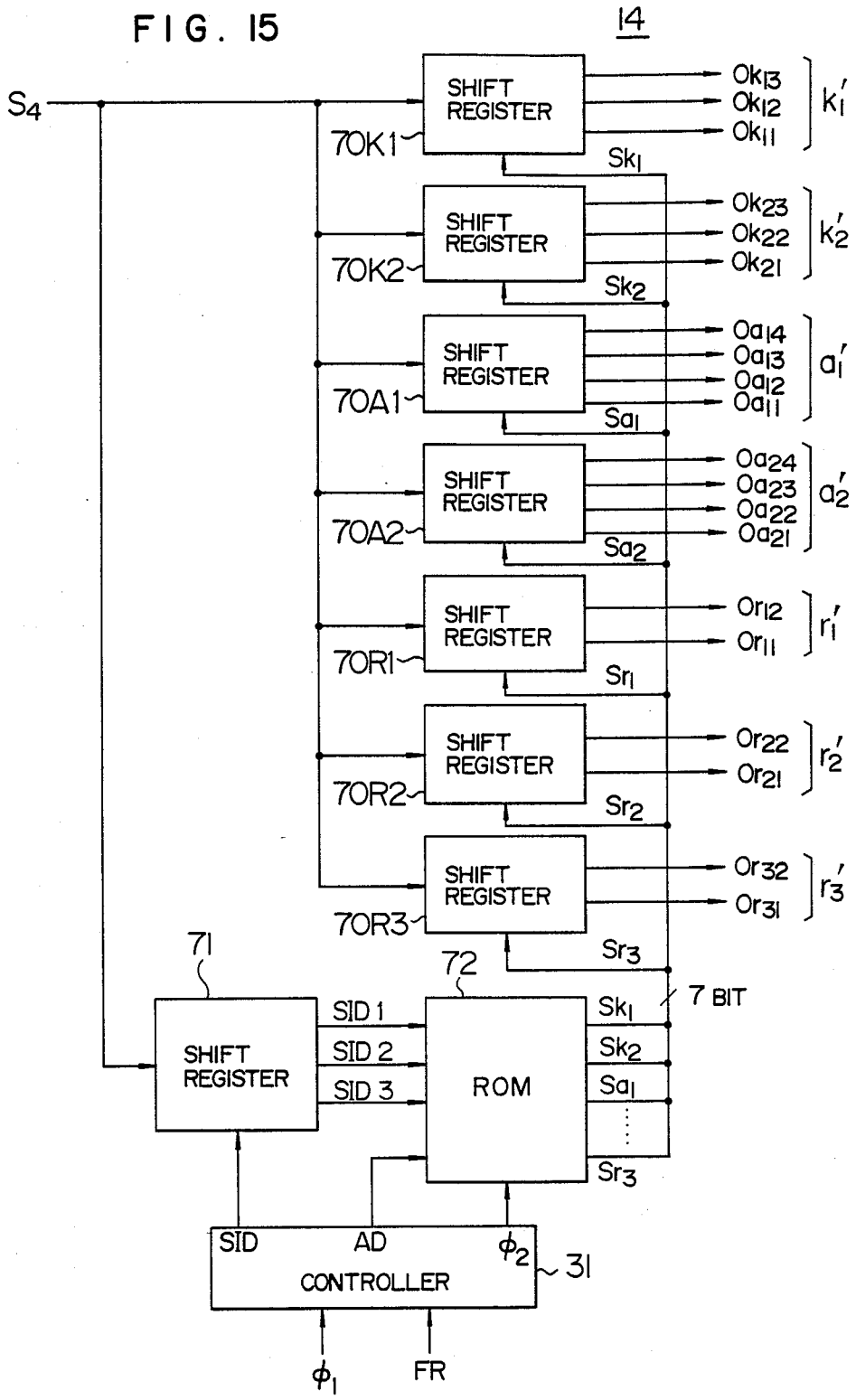
FIG. 15 is a block diagram illustrating an example of the concrete construction of the inverse bit sorter 14 indicated in FIG. 15.

FIG. 15 shows an example of the concrete construction of the inverse bit sorter 14 explained, referring to FIG. 7. In the FIG. 70K1-70R3 represent shift registers disposed, corresponding to the parameters $k_1$, $k_2$, $a_1$, $a_2$, $r_1$, $r_2$ and $r_3$, respectively; 71 is a shift register for holding a sort type indicator ID; 72 is an ROM for storing previously a plurality of bit patterns corresponding to IDs for driving the shift registers 70K1-70R3 described above; and 31 is a control circuit for generating various kinds of control signals on the basis of a starting signal FR coming from a device of higher rank (e.g. a communication control device) and a synchronizing clock $\phi_1$.

Figure 16:
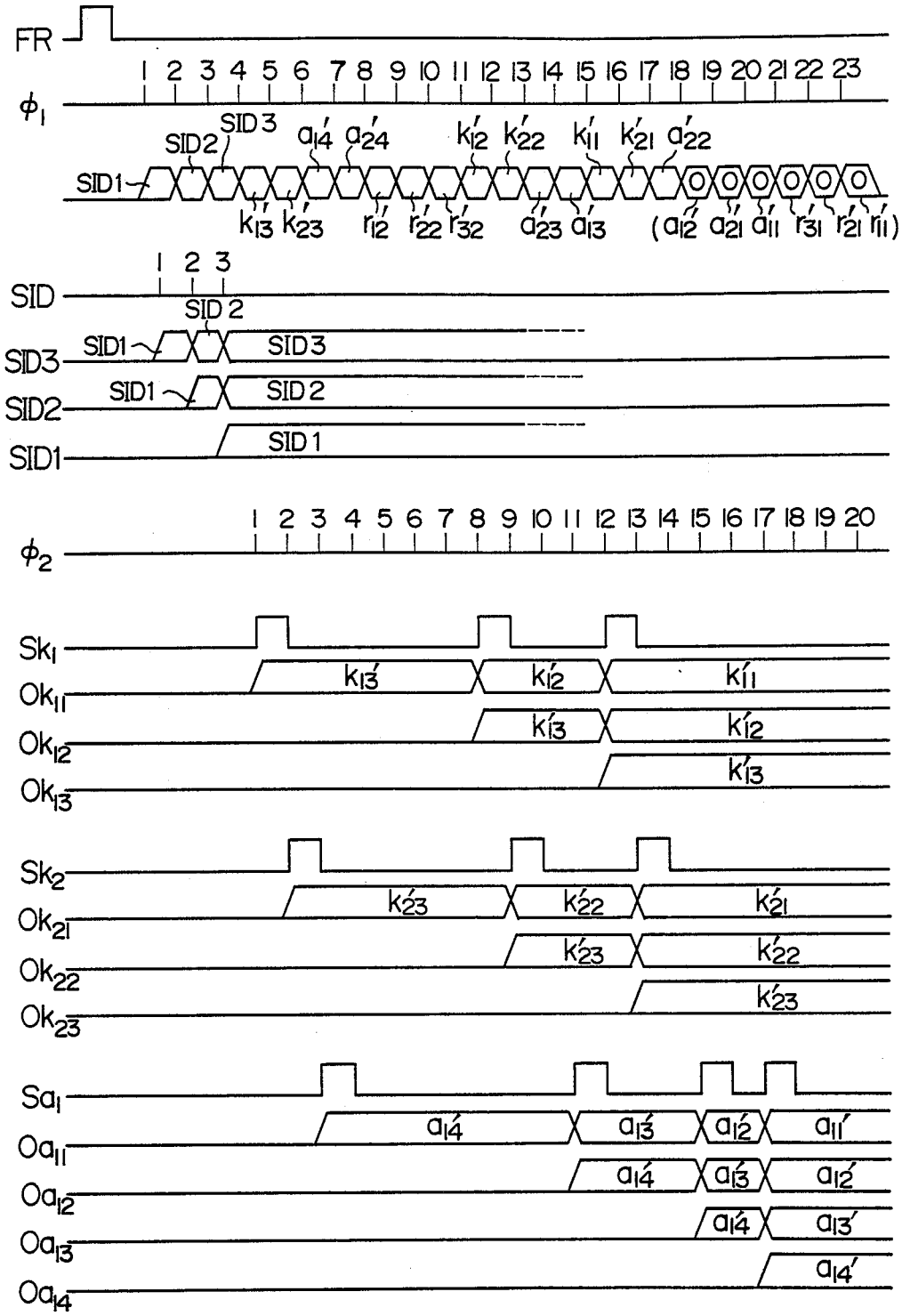
FIG. 16 is a signal timing chart for explaining the operation of the circuit indicated in FIG. 15.

The data series $S_4$ outputted by the bit filler 3 are inputted in synchronism with the synchronizing clock $\phi_1$, as indicated in FIG. 16. The control circuit 31 gives a shift register 71 a latch pulse SID in synchronism with the synchronizing clock $\phi_1$, when the starting signal FR is received. The number of outputs of the latch pulse SID is in accordance with the number of bits of the sort type indicator ID contained in the data series $S_4$ and in this example this ID consists of 3 bits of SID1-SID3. The shift register 71 takes-in the 3 bits of highest order of the data series $S_4$, responding to the latch pulse stated above, and outputs these bits in parallel.

The control circuit 31 outputs the clock $\phi_2$ and the address AD in synchronism with the synchronizing clock $\phi_1$, after latch pulses SID, whose number is equal to that of the bits of ID, is generated. The address AD is given to the ROM 72 as the address signal together with the output bits SIDl-SID3 of the shift resister 71 and the clock $\phi_1$ is given to the ROM 72 as the read-out signal. The ROM 72 includes a plurality of sort patterns corresponding to combinations of the bits of higher order SID1-SID3 of the address and a plurality of bit patterns constituting one sort pattern specified by SID1-SID3 are read-out successively, responding to the address AD. One bit pattern consists of 7 bits and the output bits of each of them are latch signals Sk1-Sr3 of the shift registers 70K1-70R3. Each of the bit patterns consists of 1 "1" bit and 6 "0" bits just as the ROM 54 indicated in FIG. 10 and either one of the shift registers takes-in the input signal in synchronism with the input of the data series $S_4$. By these bit patterns, e.g. for the data series $S_4$ following the ID indicated in FIG. 16, the latch signal SK1 drives the shift register 70K1 at the 1-st, the 8-th and the 12-th bits and the latch signal SK2 drives the shift register 70K2 at the 2-nd, the 9-th and the 13-th bits. As the result the parameters $k_1'(k_{13}', k_{12}', k_{11}')$ are successively taken in the shift register 70Kl and the parameters $k_2'(k_{23}', k_{22}', k_{21}')$ are successively taken in the shift register 70K2. The other shift registers 70A1-70R3 operate similarly and take-in the corresponding parameters $a_1'$-$r_3'$, respectively. The bits of the parameters taken in these shift registers are outputted in parallel and inputted in the parameter inverse converter 15 as the parameters k', r', a' indicated in FIG. 7.

Furthermore, although the bit filler 4 has replaced all the bits omitted for the band-width compression by "0" bits in the above explanation of the embodiment, other bit information may be given to these bit positions such that a result can be obtained, which is equal to that obtained by rounding the value of each of the parameters to the nearest whole number.

In the embodiment described above an example has been shown, in which this invention is applied to the speech coding by the thinned-out residual method. However the variable rate speech coding by the bit sort described above may be applied to source coding methods other than the thinned-out residual method; e.g. the RELP method disclosed in "The Residual Excited Linear Prediction Vocoder With Transmission Rate Below 9.6 KBPS" by C.K. Un and D.T. Megill, IEEE Trans COM-23, 1975 pp. 1466–1473; the multi-pulse method disclosed in "A New Model of LPC Excitation For producing Natural Sounding Speech At Low Bit Rates" by B.S. Atal et al., Proceeding ICASSP 82, pp. 614–617 (1982); or the APC-AB method disclosed in "Bit Allocation In Time And Frequency Domains For Predictive Coding Of Speech" by M. Honda L et al., IEEE Transaction Acoustic Speech and Signal Processing, Vol. ASSP-32, pp. 465–473, June 1984.

Furthermore, it is possible also for the speech coding by the waveform coding method to be applied the speech compression with variable rate by means of a bit stealer, e.g. by storing temporarily speech data of a plurality of samples obtained in a one-frame period, outputting successively one or a plurality of bits of highest order for each of all the samples, outputting thereafter successively following bits of lower order and outputting finally the bits of lowest order.

Figure 17:
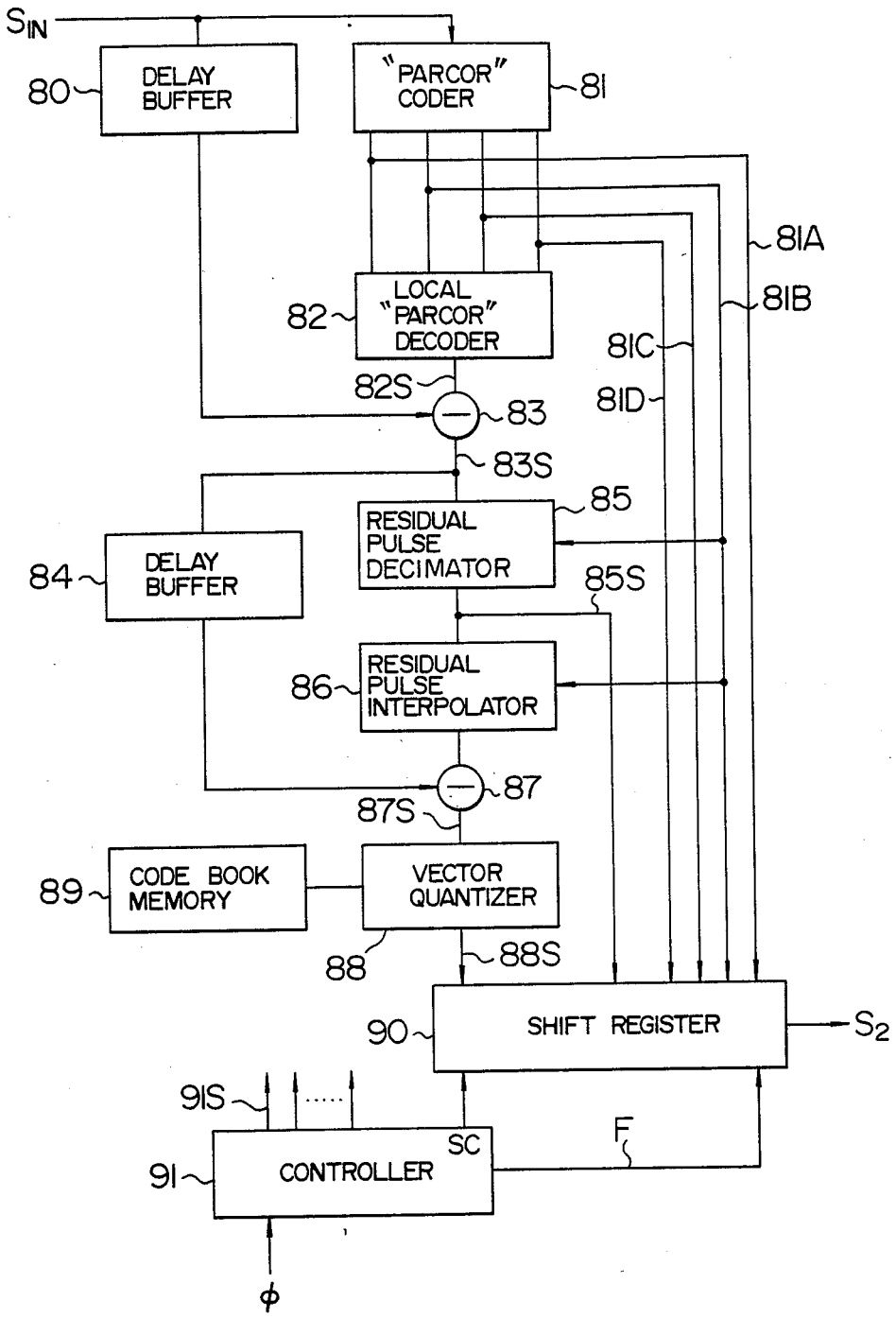
FIG. 17 is a block diagram illustrating another embodiment of the coder unit 1.

Now a second embodiment of the coding unit 1, to which this invention is applied, will be explained, referring to FIG. 17. This embodiment is an example, in which the parameters are outputted successively with decreasing importance without using any bit sorter.

The speech signals $S_{IN}$ are inputted in a delay buffer 80 and a PARCOR coder 81. The PARCOR coder 81 analyzes a plurality of sampled speech signals inputted in a one-frame period T and transforms characteristics of the speech signals contained in the relevant frame into compressed codes by expressing them by several parameters such as PARCOR coefficient (PC), a pitch period (PP), a voiced/unvoiced flag (FLG), residual power (RP), etc. These parameters are inputted in a shift register 90 and a local PARCOR decoder 82 through signal lines 81A–81D. The pitch period (PP) is inputted also in circuits 85 and 86. The local PARCOR decoder 82 reproduces the speech signals on the parameters described above. The reproduced speech signals 82S are inputted in a difference extraction circuit 83 together with the original speech signals stored in the delay buffer 82 and error signals in the PARCOR coding are obtained.

The error signals described above correspond to the residual signals stated previously and they are inputted successively in a second delay buffer 84 and a residual pulse thinning-out or decimator circuit 85. In the residual pulse decimator circuit 85, e.g. by the method disclosed in Japanese Patent Application No. Sho 59-5583 (JP-A-60-150100) filed by the same assignee as that of this invention, a plurality of representative residual pulses having large amplitudes in one pitch period are extracted. The extraction of the representative residual pulses having large amplitudes in on pitch period are extracted. The extraction of the representive residual pulses may be accomplished also by extracting continuously residual pulses contained in a portion of the pitch period, where the amplitude is large.

Signals representing the representative residual pulses thus obtained are inputted in a shift register 90 and a residual pulse interpolation circuit 86 through a signal line 85S. The residual pulse interpolation circuit 86 generates residual pulses in a oneframe period on the basis of the inputted representative residual pulse signal and the pitch period (PP), which has been previously inputted from the PARCOR coder 81. The generated residual pulses are inputted in a second difference extraction circuit 87 together with the error signals stored in the delay buffer 84 and thus error signals 87S can be obtained.

The error signals 87S are inputted in a vector quantization circuit 88. The vector quantization circuit 88 compares the inputted signals with vector data previously prepared in a code book memory 89 and outputs the index of the closest vector data to a shift register 90 through a signal line 88S. This kind of vector quantization circuits 88 is discussed e.g. in IEEE ASSP Magazine, Vol. 1, No. 2, pp. 4–29 (1984).

Figure 18:
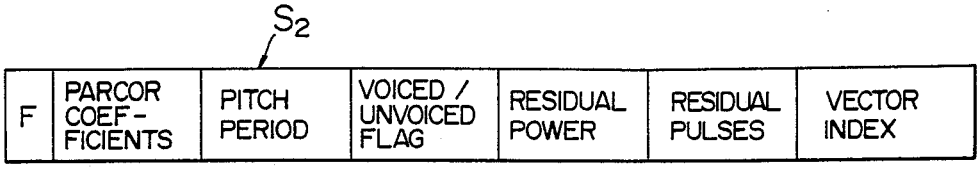
FIG. 18 shows the format of the coded data $S_2$ outputted by the coder unit indicated in FIG. 17.

The shift register 90 receives various kinds of data described above and arranged according to the order of the priority, and outputs the data series $S_2$ with the format indicated in FIG. 18 from the parameter having the highest priority with decreasing priority by the shift clock SC from a control circuit 91. Further the operation of the circuits other than the shift register 90 is controlled by control signals 91S from the control circuit 91.

The data portion of the data series $S_2$ exceeding the bit rate is deleted by a bit stealer 2 connected with the coding unit. In this case, since various kinds of parameters are inputted in the bit stealer 2 with decreasing importance, the bit stealer can effect the variable rate speech compression by just allowing the received data in a period of time corresponding to the bit rate to pass through.

Figure 19:
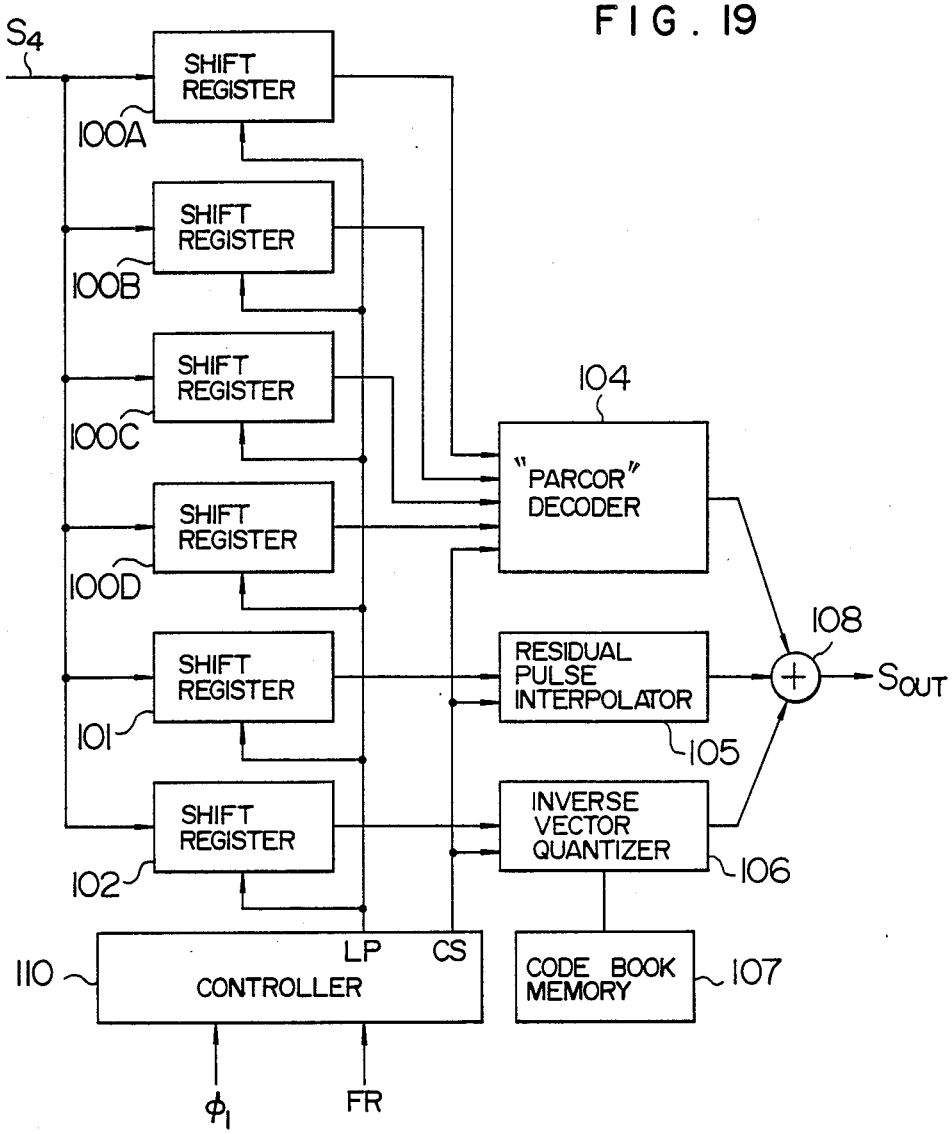
FIG. 19 is a block diagram illustrating an embodiment of the decoder unit paired with the coder unit indicated in FIG. 17.

FIG. 19 indicates the construction of the decoding unit 5 corresponding to the coder indicated in FIG. 18.

On the receiver side, the signal $S_4$, which has passed through the bit filler 4, is inputted also in a plurality of shift registers 100A-102 disposed corresponding to each of the parameters. These shift registers takes-in the input signal $S_4$ with a predetermined timing by latch signals LP given by a control circuit 110. The shift registers 100A–100D receive the parameters indicating the PARCOR coefficient, the pitch period, the voiced-/unvoiced flag and the residual power, respectively. These parameters are inputted with a predetermined timing in a PARCOR decoder 104 and decoded. The shift register 101 takes-in the parameter indicating the representative residual pulse and transmits it to a residual pulse interpolation circuit 105. In the same way the shift register 102 takes-in a vector index and transmits it to an inverse vector quantizer 106. The residual pulse interpolation circuit 105 outputs decoding signals remedying errors due to the PARCOR coding. The inverse vector quantizer 106 reads out vector data corresponding to the inputted vector index from a code book memory 107 and outputs it. These results of each coding are outputted successively in synchronism with the synchronizing clock CS from a control circuit 110 and added in an adder 108 so as to become a decoded speech signal $S_{OUT}$. In the case where the allowed bit rate is high and the inputted signal $S_4$ contains useful data for all the parameters, the output signal $S_{OUT}$ produces a speech of high quality including extremely small errors. With decreasing bit rate the output of the vector inverse quantizer 106 at first and then the output of the residual pulse interpolation circuit 105 become invalid and the sound quality decreases gradually. However this method is useful for the variable rate data compression, whose coding bit rate according to the PARCOR method is the smallest (e.g. 4.8k bit/sec).

We claim:

1. A method for transmitting coded signals with variable bit rate comprising:

the step of transforming original signals each inputted during a predetermined period of time into a first group of coded data representing characteristics of said original inputted signals;

the step of obtaining error signals corresponding to the difference between signals reproduced on the basis of said first group of coded data and said inputted original signals;

the step of transforming said error signals into a second group of coded data, said first group of coded data being assigned a high priority and said second group of coded data being assigned a low priority; and the further step of transmitting said coded data by an amount corresponding to a determined transmission rate.

2. A method for transmitting coded signals with variable bit rate comprising:

the step of analyzing signals inputted during a predetermined period of time and transforming the inputted signals into a plurality of coded data representing characteristics of said original inputted signals;

the step of arranging said plurality of coded data in an order of decreasing priority in the decoding of the signals wherein said plurality of coded data are decomposed in units of a bit and rearranged in said order of bits of decreasing priority, or on the basis of one order selected from a plurality of previously prepared sort patterns, depending on inputted signals, and the step of transmitting said arranged coded data in the order of decreasing priority by an amount of data corresponding to a determined transmission rate.

3. A method for transmitting coded signals according to claim 2, wherein a series of data comprising said rearranged bits are transmitted, following identification of the sort pattern applied to said rearrangement.

4. A method for transmitting coded signals according to claim 2 wherein said step of arranging comprises:

the step of applying successively a plurality of previously prepared sort patterns so as to transform the bits of said coded data into a plurality of series of data having different bit arrangement; and the step of evaluating the deterioration of coded signals for each of sad series of data, when they are data-compressed, depending on said transmission bit rate, and finding the optimum sort pattern, said transmitting step being effected to the series of data obtained by using said optimum sort pattern.

5. A method for transmitting coded signals according to claim 4, wherein said series of data are transmitted, following the determination of said optimal sort pattern.

6. A method for transmitting coded signals according to claim 4, wherein said step of arranging includes a step of first deciding the type of said inputted signals and then the formation of said plurality of series of data having different bit arrangement according to a plurality of sort patterns selected on the basis of the result of said decision.

7. A speech transmission system for transmitting coded signals with variable bit rate comprising:

coding means for transforming original signals each inputted in a predetermined period of time into a plurality of coded data representing characteristics thereof, wherein said coding means comprises first coding means for transforming said inputted signals into a first group of coded data with a predetermined coding algorithm, means for obtaining error signals corresponding to the difference between signals reproduced on the basis of said first group of coded data and said inputted original signals, and second coding means for transforming said error signals into a second group of coded data, said first group of coded data at first and then said second group of coded data being outputted by said data arranging means;

data arranging means connected with said coding means for outputting said plurality of coded data in an order of decreasing priority in the reproducing of the original signals; and means for allowing a series of coded data outputted by said data arranging means to pass an amount of data corresponding to a determined transmission rate.

8. A signal transmission system for transmitting coded signals with variable bit rate comprising:

coding means for analyzing speech signals inputted in a predetermined period of time and transforming the inputted signals into a plurality of coded data representing characteristics thereof;

data arranging means connected with said coding means for outputting said plurality of coded data in an order of decreasing priority in the decoding of the speech signals, wherein said data arranging means includes means for decomposing said plurality of coded data in unit of a bit and memory means for storing a plurality of sort patterns, the rearranging means rearranging the bits on the basis of a sort pattern read-out from said memory means depending on the inputted speech signals, said coded data being outputted in an order of bits of decreasing priority; and means for allowing a series of coded data outputted by said data arranging means to pass an amount of data corresponding to a determined transmission rate.

9. A signal transmission system according to claim 8, wherein said data arranging means comprises:

rearranging means for applying successively a plurality of sort patterns previously prepared so as to transform the bits of said coded data into a plurality of series of data having different bit arrangements; and means for selecting the series of data for which the deterioration of the speech quality is smallest among said plurality of series of data when the amount of data is reduced, depending on said determined bit rate.

10. A speech signal transmission system according to claim 9, wherein said data arranging means includes means for outputting identification information of the sort pattern corresponding to the selected series of data together with said series of data.

11. A speech signal transmission system according to claim 9, wherein said data arranging means includes: classifying means for assigning said inputted speech signals to one of a plurality of classifications previously determined; said memory means storing a plurality of sort patterns for every classification; said rearranging means reading-out said plurality of sort patterns for rearranging data bits on the basis of the decision of said classifying means.

* * * * *